US011810512B2

(12) United States Patent
Xu

(10) Patent No.: US 11,810,512 B2
(45) Date of Patent: Nov. 7, 2023

(54) PIXEL CIRCUIT AND DISPLAY PANEL

(71) Applicant: TCL CHINA STAR OPTOELECTRONICS TECHNOLOGY CO., LTD., Guangdong (CN)

(72) Inventor: Jian Xu, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/623,907

(22) PCT Filed: Dec. 22, 2021

(86) PCT No.: PCT/CN2021/140286

§ 371 (c)(1),
(2) Date: Dec. 30, 2021

(65) Prior Publication Data

US 2023/0197008 A1 Jun. 22, 2023

(30) Foreign Application Priority Data

Dec. 16, 2021 (CN) ..... 202111545710.9

(51) Int. Cl.
*G09G 3/325* (2016.01)
*G09G 3/3275* (2016.01)

(52) U.S. Cl.
CPC ..... *G09G 3/325* (2013.01); *G09G 3/3275* (2013.01); *G09G 2300/0852* (2013.01); *G09G 2320/0271* (2013.01); *G09G 2320/0633* (2013.01)

(58) Field of Classification Search
CPC ..... G09G 3/325; G09G 3/3275; G09G 2300/0852; G09G 2320/0271; G09G 2320/0633
See application file for complete search history.

(56) References Cited

U.S. PATENT DOCUMENTS 7,119,773 B2 * 10/2006 Kim ..... G09G 3/3233 345/63
11,361,701 B1 * 6/2022 Tung ..... H03K 5/1565
(Continued)

FOREIGN PATENT DOCUMENTS

CN 111739464 A 10/2020
CN 112669762 A 4/2021
(Continued)

OTHER PUBLICATIONS

International Search Report in International application No. PCT/CN2021/140286, dated Apr. 26, 2022.
(Continued)

*Primary Examiner* — Ibrahim A Khan
(74) *Attorney, Agent, or Firm* — PV IP PC; Zhigang Ma; Wei Te Chung

(57) ABSTRACT

A pixel circuit and a display panel are disclosed. The pixel circuit comprises a first transistor, a pulse amplitude driving module, and a pulse width driving module. The pixel circuit and the display panel utilize a pulse amplitude driving module to drive the first transistor when a middle to high gray value of a frame is being displayed such that the number of frequency divisions in a high gray value could be reduced. Furthermore, the pixel circuit and the display panel utilize a pulse width driving module to drive the first transistor when a middle to low gray value of the frame is being displayed to improve the light emitting efficiency and luminance evenness in a low gray value.

16 Claims, 3 Drawing Sheets

(56) References Cited

U.S. PATENT DOCUMENTS

| | | | | |
|---|---|---|---|---|
| 2002/0140659 | A1 | 10/2002 | Mikami et al. | |
| 2006/0146827 | A1* | 7/2006 | Kim | G09G 3/3216 370/392 |
| 2018/0293929 | A1* | 10/2018 | Shigeta | G09G 3/3233 |
| 2019/0371231 | A1* | 12/2019 | Kim | G09G 3/2081 |
| 2019/0371232 | A1* | 12/2019 | Kim | H01L 25/0753 |
| 2020/0111403 | A1* | 4/2020 | Kim | G09G 3/32 |
| 2020/0111404 | A1* | 4/2020 | Kim | G09G 3/2014 |
| 2020/0312216 | A1* | 10/2020 | Kim | G09G 3/32 |
| 2020/0394953 | A1* | 12/2020 | Kim | G09G 3/32 |
| 2021/0241682 | A1* | 8/2021 | Jung | H01L 27/156 |
| 2022/0101783 | A1* | 3/2022 | Han | G09G 3/32 |
| 2022/0114951 | A1* | 4/2022 | Chang | G09G 3/14 |
| 2022/0198995 | A1* | 6/2022 | Ahmed | H01L 27/1255 |
| 2022/0199001 | A1* | 6/2022 | Kim | G09G 3/3233 |
| 2022/0319397 | A1* | 10/2022 | Kim | G09G 3/2003 |
| 2023/0082959 | A1* | 3/2023 | Jeong | G09G 3/32 345/55 |
| 2023/0154372 | A1* | 5/2023 | Hwang | G09G 3/32 345/691 |

FOREIGN PATENT DOCUMENTS

| | | | |
|---|---|---|---|
| CN | 113066423 | A | 7/2021 |
| CN | 113487994 | A | 10/2021 |
| CN | 113658551 | A | 11/2021 |
| CN | 113707077 | A | 11/2021 |

OTHER PUBLICATIONS

Written Opinion of the International Search Authority in International application No. PCT/CN2021/140286, dated Apr. 26, 2022.

* cited by examiner

PIXEL CIRCUIT AND DISPLAY PANEL

FIELD OF THE DISCLOSURE

The present disclosure relates to a display technology, and more particularly, to a pixel circuit and a display panel.

BACKGROUND

As the rapid development of the display technology, the display driving technique becomes one of the key points. The display driving technology has two common techniques: pulse amplitude modulation (PAM) and pulse width modulation (PWM).

Please refer to FIG. 1. FIG. 1 is a diagram showing a relationship between a current and a luminance in a conventional PAM driving technique. As shown in FIG. 1, a conventional PAM driving technique achieves different luminance (Lv) through controlling the amplitude of the current (I). The advantage of the PAM driving technique is that the control method is simple. The disadvantage of it is that the light emitting device has a low light emitting efficiency and a high power consumption at a low gray value (a low current). In addition, the light meeting device has lower luminance evenness in a low current and thus a pitting issue occurs.

Please refer to FIG. 2. FIG. 2 is a diagram showing a relationship between the number of gray levels and the number of frequency divisions in a conventional PWM driving technique. As shown in FIG. 2, the PWM driving technique achieves different luminance by controlling the time duration that the current flows through the light emitting device given that the current remains the same amplitude. For example, from the first sub-field 1SBF to the eighth sub-field 8SBF, the number of the gray levels of each of the sub-fields orderly increases from 1 to 2, 4, 8, 16, 32, 64 and 128. Correspondingly, the light emitting time duration becomes longer and the number of the frequency divisions of the control signal for controlling the light emitting time duration increases as well. The advantage is that the light emitting efficiency of the light emitting device is higher and the display evenness is better. However, because it needs to use the frequency division method (different light emitting durations need to be arranged in different sub-fields of the same frame) to control the display time, a higher resolution needs more gray levels and higher frequency of the control signal for controlling the output of the chip (IC). This makes it difficult for the chip to support this driving technique.

From the above, it could be understood that a novel driving technique needs to be provided to improve the light emitting efficiency and display evenness in a low gray value and the need for more frequency divisions in a high gray value.

SUMMARY

One objective of an embodiment of the present disclosure is to provide a pixel circuit and a display panel to improve the light emitting efficiency and display evenness in a low gray value and the need for more frequency divisions in a high gray value.

According to an embodiment of the present disclosure, a pixel circuit is disclosed. The pixel circuit comprises a first transistor, a pulse amplitude driving module, and a pulse width driving module. The pulse amplitude driving module is electrically connected to a gate of the first transistor and configured to drive the first transistor when a middle to high gray value of a frame is being displayed. The pulse width driving module is electrically connected to the gate of the first transistor and configured to drive the first transistor when a middle to low gray value of the frame is being displayed.

Optionally, a first electrode of the first transistor is configured to receive a positive power signal. The pulse amplitude driving module writes a data signal into the gate of the first transistor when the positive power signal corresponds to a first voltage level. The pulse amplitude driving module initializes a voltage level of a second electrode of the first transistor.

Optionally, when the data signal corresponds to a third voltage level and the positive power signal corresponds to the first voltage level, the pulse width driving module writes the data signal. The pulse width driving module reduces a voltage level of the gate of the first transistor during a light emitting phase of the pixel circuit.

Optionally, when the data signal corresponds to a fourth voltage level, the pulse amplitude driving module writes the data signal in the gate of the first transistor. When the positive power signal corresponds to a second voltage level, the pixel circuit is working in the light emitting phase. The first voltage level is lower than the second voltage level; and the third voltage level is lower than the fourth voltage level.

Optionally, the pixel circuit further comprises a data line. The pulse amplitude module comprises a second transistor. A first electrode of the second transistor is electrically connected to the data line, a gate of the second transistor is configured to receive a pulse amplitude control signal, and a second electrode is electrically connected to the gate of the first transistor.

Optionally, the pulse amplitude driving module further comprises a third transistor. The third transistor includes a first electrode configured to receive a first reference signal, a gate configured to receive a pulse amplitude control signal, and a second electrode electrically connected to the second electrode of the first transistor.

Optionally, the pulse width driving module comprises a fourth transistor, a fifth transistor, and a first capacitor. The fourth transistor includes a first electrode configured to receive a second reference signal, a second electrode electrically connected to the gate of the first transistor. The fifth transistor includes a first electrode electrically connected to the data line, a gate configured to receive a pulse width control signal, and a second electrode electrically connected to the gate of the fourth transistor. The first capacitor includes two ends respectively electrically connected to a gate of the fourth transistor and a triangle control signal.

Optionally, the pixel circuit further comprises a second capacitor and a light emitting device. The second capacitor has two ends respectively electrically connected to the gate of the first transistor and the second electrode of the first transistor. The light emitting device has an anode electrically connected to the second electrode of the first transistor and a cathode configured to receive a negative power signal.

Optionally, a voltage level of the negative power signal is identical to a voltage level of the first reference signal and/or a voltage level of the second reference signal.

According to an embodiment of the present disclosure, a display panel is disclosed. The display panel comprises the above-mentioned pixel circuit.

According to an embodiment of the present disclosure, a pixel circuit and a display panel are disclosed. The pixel circuit and the display panel utilize a pulse amplitude driving module to drive the first transistor when a middle to high gray value of a frame is being displayed such that the number of frequency divisions in a high gray value could be reduced. Furthermore, the pixel circuit and the display panel utilize a pulse width driving module to drive the first transistor when a middle to low gray value of the frame is being displayed to improve the light emitting efficiency and luminance evenness in a low gray value.

BRIEF DESCRIPTION OF THE DRAWINGS

Some example embodiments of the present invention will be described below in detail with reference to the accompanying drawings.

DETAILED DESCRIPTION

Figure 1:
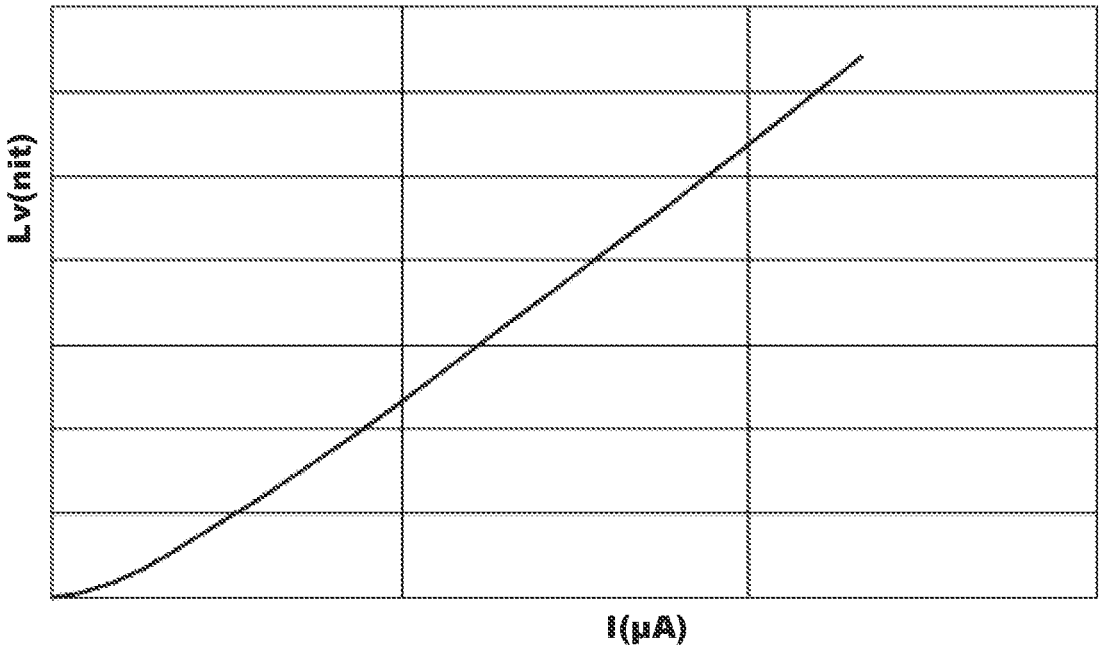
Fig. 1 (Prior art)
FIG. 1 is a diagram showing a relationship between a current and a luminance in a conventional PAM driving technique.
Figure 2:
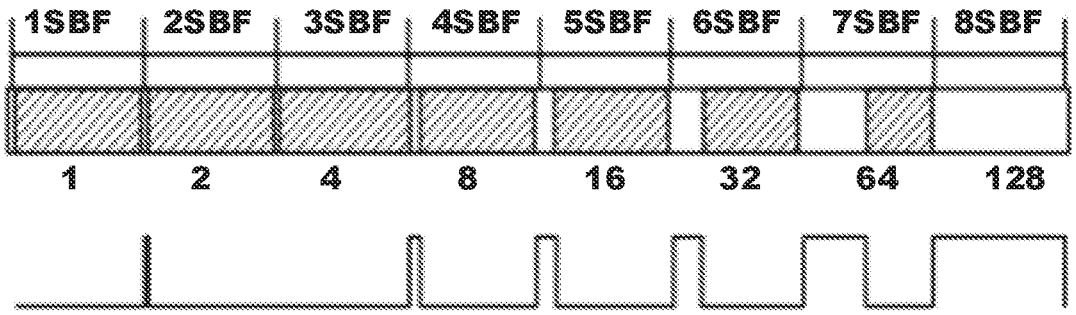
Fig. 2 (Prior art)
FIG. 2 is a diagram showing a relationship between the number of gray levels and the number of frequency divisions in a conventional PWM driving technique.

Embodiments of the present present disclosure are illustrated in detail in the accompanying drawings, in which like or similar reference numerals refer to like or similar elements or elements having the same or similar functions throughout the specification. The embodiments described below with reference to the accompanying drawings are exemplary and are intended to be illustrative of the present disclosure, and are not to be construed as limiting the scope of the present disclosure.

Figure 3:
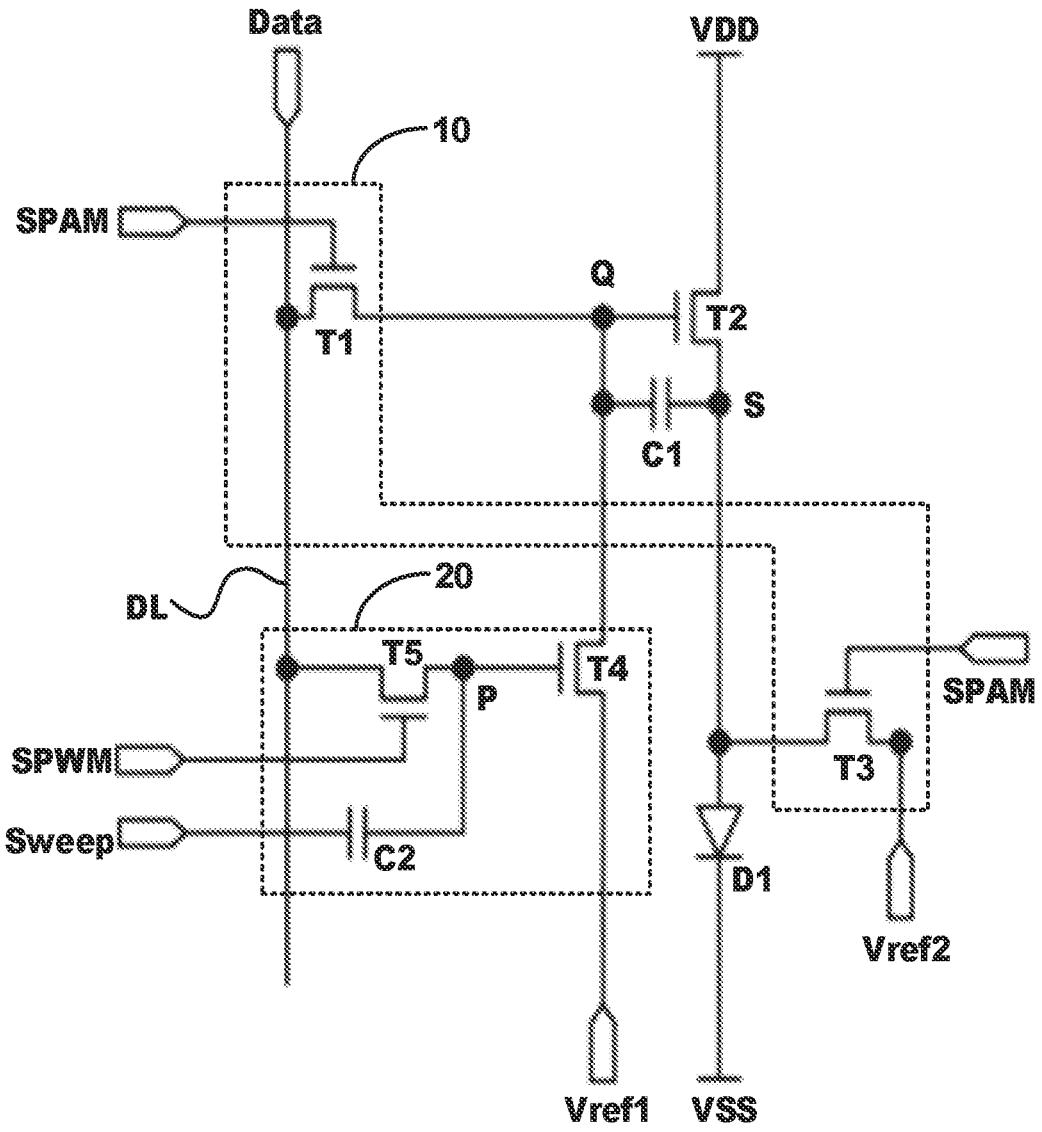
FIG. 3 is a diagram of a pixel circuit according to an embodiment of the present disclosure.
Figure 4:
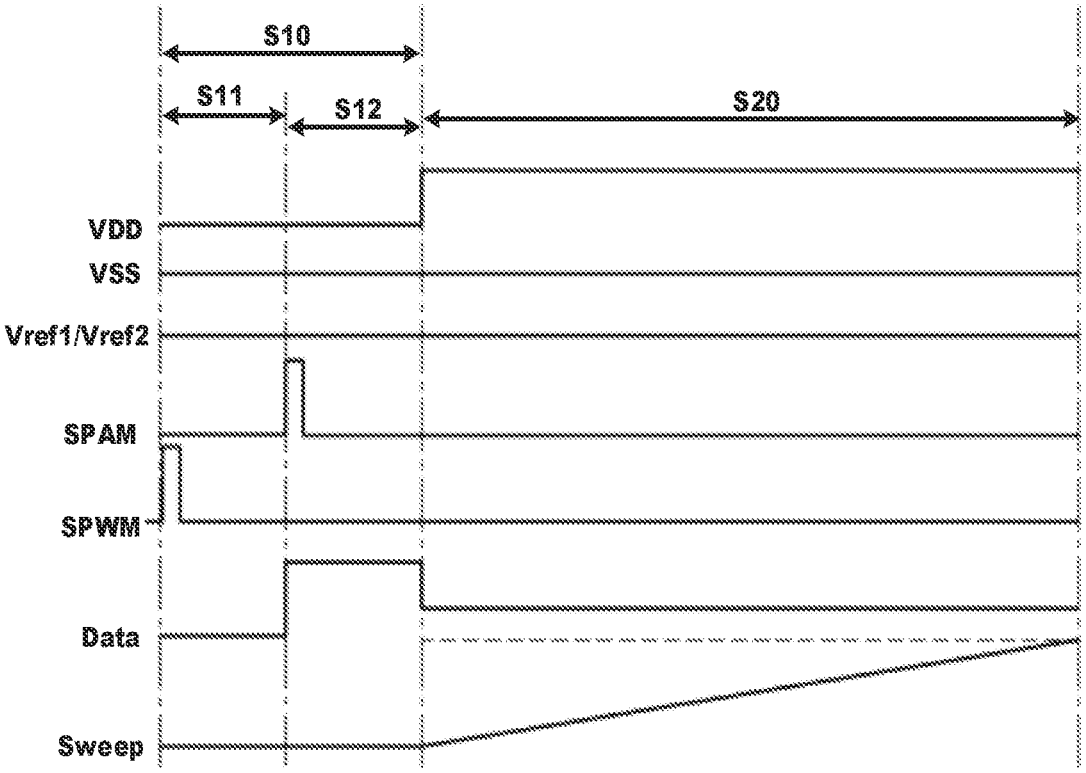
FIG. 4 is a timing diagram of the pixel circuit shown in FIG. 3.
Figure 5:
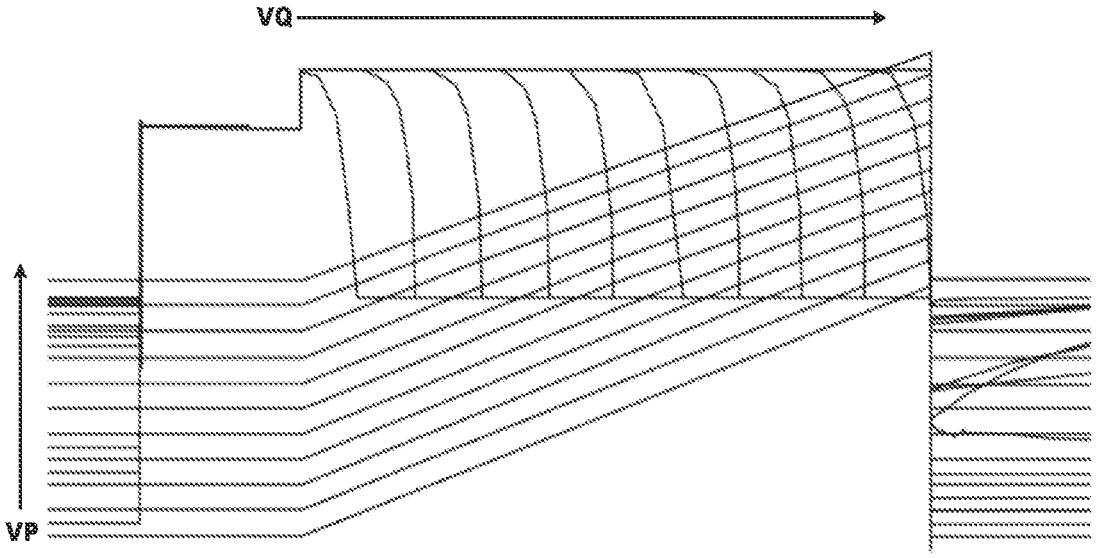
FIG. 5 is a diagram showing a relationship between a voltage level VP of the node P and a voltage level VQ of the node Q according to an embodiment of the present disclosure.

As previously mentioned, the conventional display panel has a low light emitting efficiency and display unevenness in a low gray value and needs more frequency divisions in a high gray value. To alleviate the above issues, a pixel circuit is disclosed according to an embodiment of the present disclosure. Please refer to FIGS. 3-5. FIG. 3 is a diagram of a pixel circuit according to an embodiment of the present disclosure. FIG. 4 is a timing diagram of the pixel circuit shown in FIG. 3. FIG. 5 is a diagram showing a relationship between a voltage level VP of the node P and a voltage level VQ of the node Q according to an embodiment of the present disclosure. The pixel circuit comprises a first transistor T2, a pulse amplitude driving module 10 and a pulse width driving module 20. The pulse amplitude driving module 10 is electrically connected to the gate of the first transistor T2 and is configured to drive the first transistor T2 when a middle to high gray value of a frame is being displayed. The pulse width driving module 20 is electrically connected to the gate of the first transistor T1 and is configured to drive the first transistor when a middle to low gray value of the frame is being displayed.

In this embodiment, the pixel circuit utilizes the pulse amplitude driving module 10 to drive the first transistor T2 when a middle to high gray value of a frame is being displayed. This could avoid too many frequency divisions when a high gray value is being displayed. In addition, the pixel circuit utilizes the pulse width driving module 20 to drive the first transistor when a middle to low gray value of the frame is being displayed. This could raise the light emitting efficiency and avoid display unevenness a low gray value of the frame is being displayed.

The pixel circuit comprises a data line DL. The pulse amplitude driving module 10 comprises a second transistor T1. The first electrode of the second transistor T1 is electrically connected to the data line DL. The gate of the second transistor T1 is configured to receive a pulse amplitude control signal SPAM. The second electrode of the second transistor T1 is electrically connected to the gate of the first transistor T2.

The pulse amplitude control signal SPAM could real-time connect the data signal DL in the data line to the gate of the first transistor T2 to drive the first transistor T2 when a middle to high gray value of a frame is being displayed. This could reduce the number of the frequency divisions when a middle to high gray value of a frame is being displayed.

The pulse amplitude driving module 10 further comprises a third transistor T3. The first electrode of the third transistor T3 is configured to receive the first reference signal Vref 2. The gate of the third transistor T3 is configured to receive the pulse amplitude control signal SAPM. The second electrode of the third transistor T3 is electrically connected to the first electrode of the first transistor T2.

The pulse amplitude control signal SPAM could control the third transistor T3 to initialize the voltage level of the first electrode of the first transistor T2 to make consistent with the voltage level of the first reference Vref2 such that the accuracy of the luminance of each frame is raised. The channel type of the second transistor T1 could be the same as the channel type of the third transistor T3. In this way, the second transistor T1 and the third transistor T3 could be turned on/off by the same control signal. This could reduce the number of signal lines and the control signal, simplify the structure of the pixel circuit and raise the aperture rate.

The pulse width driving module 20 comprises a fifth transistor T5, a fourth transistor T4 and a capacitor C2. The first electrode of the fifth transistor T5 is electrically connected to the data line DL. The gate of the fifth transistor T5 is configured to receive a pulse width control signal SPWM. The first electrode of the fourth transistor T4 is configured to receive the second reference signal Vref1. The gate of the fourth transistor T4 is electrically connected to the second electrode of the fifth transistor T5. The second electrode of the fourth transistor T4 is electrically connected to the first transistor T2. One end of the capacitor C2 is electrically connected to the gate of the fourth transistor T4 and the other end of the capacitor C2 is configured to receive the triangle control signal Sweep.

The pulse width control signal SPWN could real-time control the on/off state of the fifth transistor T5 to clamp the voltage level of the node P to the third voltage level of the data signal Data. During a low gray value is being displayed in the light emitting phase, as the triangle wave control signal Sweep rises, the fourth transistor T4 is turned on such that the voltage level of the node Q is pulled down to the voltage level of the second reference signal Vref1 to turn off the first transistor T2. This could raise the light emitting efficiency when a low gray value is being displayed and avoid the display unevenness.

The pixel circuit further comprises a capacitor C1 and a light emitting device D1. One end of the capacitor C1 is electrically connected to the gate of the first transistor T2. The other end of the capacitor C1 is electrically connected to the source of the first transistor T2. The anode of the light emitting device D1 is electrically connected to the source of the first transistor T2. The cathode of the light emitting device D1 is configured to receive the negative power signal VSS.

The light emitting device D1 could be a mini LED, a micro LED or an OLED.

The source of the first transistor T2 is configured to receive the positive power signal VDD.

As shown in FIG. 3 and FIG. 4, the operation of the pixel circuit in a frame could comprise a write-in phase S10 and a light emitting phase S20.

Write-in phase S10: the write-in phase S10 could comprise a first phase S11 and a second phase S12.

Here, the first phase S11: the pulse width control signal SPWM jumps to a high voltage level to turn on the fifth transistor T5. Through the data signal Data, an initial voltage level is written into the node P. And then, the pulse width control signal SPWM transits from a high voltage level to a low voltage level to turn off the fifth transistor T5. And then, the second transistor T1, the first transistor T2, the third transistor T3, the fourth transistor T4 and the fifth transistor T5 are all turned off and the light emitting device D1 has no current passing through.

Second phase S12: the pulse width control signal SPAM jumps to a high voltage level to turn on the second transistor T1 and the third transistor T3 such that the data signal Data is written to the node Q and the first reference signal Vref2 is written to the node S. Then, the pulse width control signal SPAM transits from a high voltage level to a low voltage level to turn off the second transistor T1 and the third transistor T3. The first transistor T2 is turned on under the effect of the voltage difference $V_{QS}$ between the node Q and the node S. At this time, the positive power signal VDD corresponds to a low voltage level. Thus, the light emitting device D1 does not generate light.

Light emitting phase S20: the light emitting phase S20 could comprise a third phase and a fourth phase.

Third phase: the positive power signal VDD transits from a low voltage level to a high voltage level and the light emitting device D1 starts to generate light. In this phase, the voltage difference $V_{QS}$ between the node Q and the node S controls the current flowing through the first transistor T2 and thus controls the luminance of the light emitting device D1. This is the PAM driving.

Fourth phase: the triangle control signal Sweep gradually rises and thus the voltage level of the node P also rises through the coupling effect of the capacitor C2. When the voltage level of the node P rises to a certain voltage level, the fourth transistor T4 is turned on and the voltage level of the node Q is pulled down to the voltage level of the second reference signal Vref1. The first transistor T2 is turned off and the light emitting device D1 no longer generates light. In this phase, through the amplitude of the initial voltage level of the node P, the light emitting time duration of the light emitting device D1 could be controlled. This is the PWM driving.

Here, the positive power signal VDD has a first voltage level and a second voltage level. The first voltage level is lower than the second voltage level. The first voltage level could be a ground level.

The data signal Data has a third voltage level, a fourth voltage level and a fifth voltage level. The third voltage level is lower than the fourth voltage level. The fifth voltage level is between the third voltage level and the fourth voltage level and the fifth voltage level could be, but not limited to, a ground level. In the first phase S11, the data signal Data corresponds to the third voltage level. In the second phase S12, the data signal Data corresponds to the fourth voltage level. In the light emitting phase S20, the data signal Data corresponds to the fifth voltage level.

At least one of the first reference signal Vref2, the second reference signal Vref1 and the negative power signal VSS could be, but not limited to, a ground level. That is, the voltage level of the negative power signal VSS is the same as the first reference signal Vref2 and/or the second reference signal Vref1. Or, the first reference signal Vref2, the second reference signal Vref1 and the negative power signal VSS could share the same transmission line. In this way, the number of the input signal lines of the pixel circuit could be reduced and thus the pixel density could be raised.

When the positive power signal VDD corresponds to a first voltage level, the pulse width driving module 10 writes the data signal Data into the gate of the first transistor T2. At the same time, the pulse amplitude driving module initializes the voltage level of the source of the first transistor T2.

When the data signal Data corresponds to the third voltage level and the positive power signal VDD corresponds to the first voltage level, the pulse width driving module 20 writes the data signal Data. In addition, the pulse width driving module 20 is configured to reduce the voltage level of the gate of the first transistor T2 in the light emitting phase of the pixel circuit.

When the data signal Data corresponds to the fourth voltage level, the pulse amplitude driving module 10 writes the data signal Data into the gate of the first transistor T2. In addition, when the positive power signal VDD transits from the first voltage level to the second voltage level, the pixel circuit is in the light emitting phase.

In the above embodiments, the second transistor T1, the first transistor T2, the third transistor T3, the fourth transistor T4 and the fifth transistor T5 are all N-type TFTs. Therefore, the waveforms of each of the above-mentioned signals are as shown in FIG. 4. In another embodiment, the second transistor T1, the first transistor T2, the third transistor T3, the fourth transistor T4 and the fifth transistor T5 are all P-type TFTs. For this configuration, the waveforms of the corresponding signals need to be correspondingly adjusted. Similarly, in another embodiment, the second transistor T1, the first transistor T2, the third transistor T3, the fourth transistor T4 and the fifth transistor T5 could be arranged in a CMOS configuration. That is, these transistors could adopt P-type TFT as well as N-type TFT. Similarly, the waveforms of the corresponding signals need to be correspondingly adjusted.

As the simulation waveforms shown in FIG. 5, when the initial voltage VP written into the node P gets higher and higher, the voltage level of the node P rises in the same speed as the rise of the triangle wave control signal Sweep. Because the initial voltage VP gets higher and higher, the time duration for raising the voltage level of the node P to turn on the fourth transistor T4 gets shorter and shorter. This means that it become earlier to pull down the voltage level VQ of the node Q such that the time duration for the light emitting device D to generate light becomes shorter. This could better fulfill the function of the PWM driving method. Because the pixel circuit does not require a very high frequency signal, the IC does not need to have any corresponding high frequency signal. Thus, the loading pressure of the IC is reduced.

According to another embodiment, a display panel is disclosed. The display panel comprises a pixel circuit of any one of the above-mentioned embodiments.

According to an embodiment of the present disclosure, the display panel utilizes a pulse amplitude driving module 10 to drive the first transistor T2 when a middle to high gray value of a frame is being displayed such that the number of frequency divisions in a high gray value could be reduced. Furthermore, the display panel utilizes a pulse width driving module 20 to drive the first transistor T2 when a middle to low gray value of the frame is being displayed to improve the light emitting efficiency and luminance evenness in a low gray value.

Above are embodiments of the present disclosure, which does not limit the scope of the present disclosure. Any modifications, equivalent replacements or improvements within the spirit and principles of the embodiment described above should be covered by the protected scope of the disclosure.

What is claimed is:

1. A pixel circuit, comprising:

a first transistor;

a pulse amplitude driving module, electrically connected to a gate of the first transistor, configured to drive the first transistor when a middle to high gray value of a frame is being displayed;

a pulse width driving module, electrically connected to the gate of the first transistor, configured to drive the first transistor when a middle to low gray value of the frame is being displayed; and a data line;

wherein the pulse amplitude module comprises a second transistor and a third transistor, a first electrode of the second transistor is electrically connected to the data line, a gate of the second transistor is configured to receive a pulse amplitude control signal, and a second electrode is electrically connected to the gate of the first transistor; the third transistor has a first electrode configured to receive a first reference signal, a gate configured to receive a pulse amplitude control signal, and a second electrode electrically connected to the second electrode of the first transistor.

2. The pixel circuit of claim 1, wherein a first electrode of the first transistor is configured to receive a positive power signal; the pulse amplitude driving module writes a data signal into the gate of the first transistor when the positive power signal corresponds to a first voltage level; and the pulse amplitude driving module initializes a voltage level of a second electrode of the first transistor.

3. The pixel circuit of claim 2, wherein when the data signal corresponds to a third voltage level and the positive power signal corresponds to the first voltage level, the pulse width driving module writes the data signal; and the pulse width driving module reduces a voltage level of the gate of the first transistor during a light emitting phase of the pixel circuit.

4. The pixel circuit of claim 3, wherein when the data signal corresponds to a fourth voltage level, the pulse amplitude driving module writes the data signal in the gate of the first transistor; and when the positive power signal corresponds to a second voltage level, the pixel circuit is working in the light emitting phase;

wherein the first voltage level is lower than the second voltage level; and the third voltage level is lower than the fourth voltage level.

5. The pixel circuit of claim 1, wherein the pulse width driving module comprises:

a fourth transistor, having a first electrode configured to receive a second reference signal, a second electrode electrically connected to the gate of the first transistor;

a fifth transistor, having a first electrode electrically connected to the data line, a gate configured to receive a pulse width control signal, and a second electrode electrically connected to the gate of the fourth transistor; and a first capacitor, having two ends respectively electrically connected to a gate of the fourth transistor and a triangle control signal.

6. The pixel circuit of claim 5, further comprising:

a second capacitor, having two ends respectively electrically connected to the gate of the first transistor and the second electrode of the first transistor; and a light emitting device, having an anode electrically connected to the second electrode of the first transistor and a cathode configured to receive a negative power signal.

7. The pixel circuit of claim 6, wherein a voltage level of the negative power signal is identical to a voltage level of the first reference signal and/or a voltage level of the second reference signal.

8. A display panel, comprising a pixel circuit, comprising:

a first transistor;

a pulse amplitude driving module, electrically connected to a gate of the first transistor, configured to drive the first transistor when a middle to high gray value of a frame is being displayed; and a pulse width driving module, electrically connected to the gate of the first transistor, configured to drive the first transistor when a middle to low gray value of the frame is being displayed; and a data line;

wherein the pulse amplitude module comprises a second transistor and a third transistor, a first electrode of the second transistor is electrically connected to the data line, a gate of the second transistor is configured to receive a pulse amplitude control signal, and a second electrode is electrically connected to the gate of the first transistor ; the third transistor has a first electrode configured to receive a first reference signal, a gate configured to receive a pulse amplitude control signal, and a second electrode electrically connected to the second electrode of the first transistor.

9. The display panel of claim 8, wherein a first electrode of the first transistor is configured to receive a positive power signal; the pulse amplitude driving module writes a data signal into the gate of the first transistor when the positive power signal corresponds to a first voltage level; and the pulse amplitude driving module initializes a voltage level of a second electrode of the first transistor.

10. The display panel of claim 9, wherein when the data signal corresponds to a third voltage level and the positive power signal corresponds to the first voltage level, the pulse width driving module writes the data signal; and the pulse width driving module reduces a voltage level of the gate of the first transistor during a light emitting phase of the pixel circuit.

11. The display panel of claim 10, wherein when the data signal corresponds to a fourth voltage level, the pulse amplitude driving module writes the data signal in the gate of the first transistor; and when the positive power signal corresponds to a second voltage level, the pixel circuit is working in the light emitting phase;

wherein the first voltage level is lower than the second voltage level; and the third voltage level is lower than the fourth voltage level.

12. The display panel of claim 9, wherein the pulse width driving module comprises:

a fourth transistor, having a first electrode configured to receive a second reference signal, a second electrode electrically connected to the gate of the first transistor;

a fifth transistor, having a first electrode electrically connected to the data line, a gate configured to receive a pulse width control signal, and a second electrode electrically connected to the gate of the fourth transistor; and a first capacitor, having two ends respectively electrically connected to a gate of the fourth transistor and a triangle control signal.

13. The display panel of claim 12, wherein the pixel circuit further comprises:

a second capacitor, having two ends respectively electrically connected to the gate of the first transistor and the second electrode of the first transistor; and a light emitting device, having an anode electrically connected to the second electrode of the first transistor and a cathode configured to receive a negative power signal.

14. The display panel of claim 13, wherein a voltage level of the negative power signal is identical to a voltage level of the first reference signal and/or a voltage level of the second reference signal.

15. The display panel of claim 12, wherein the first transistor, second transistor, third transistor, fourth transistor and fifth transistor are N-type channel thin film transistors.

16. The display panel of claim 12, wherein the first transistor, second transistor, third transistor, fourth transistor and fifth transistor are P-type channel thin film transistors.

* * * * *